US007181157B2

(12) United States Patent
Nanno

(10) Patent No.: US 7,181,157 B2
(45) **Date of Patent: *Feb. 20, 2007**

(54) DUPLEX IMAGE FORMING DEVICE AND REVERSIBLE TRANSPORTATION UNIT

(75) Inventor: Shigeo Nanno, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 477 days.

This patent is subject to a terminal disclaimer.

(21) Appl. No.: 10/728,905

(22) Filed: Dec. 8, 2003

(65) Prior Publication Data

US 2004/0114979 A1 Jun. 17, 2004

(30) Foreign Application Priority Data

Dec. 10, 2002 (JP) ..... 2002-357897

(51) Int. Cl.
*G03G 15/00* (2006.01)
*G03G 15/16* (2006.01)
*B41J 3/60* (2006.01)

(52) U.S. Cl. ..... 399/401; 399/13; 399/110; 400/188

(58) Field of Classification Search ..... 399/401, 399/13, 110; 400/188
See application file for complete search history.

(56) References Cited

U.S. PATENT DOCUMENTS 5,839,032 A * 11/1998 Yasui et al. ..... 399/124
5,842,099 A * 11/1998 Aslam et al. ..... 399/324
6,215,970 B1 * 4/2001 Yoshikawa et al. ..... 399/124
6,564,019 B2 * 5/2003 Ahn et al. ..... 399/13
2004/0114980 A1 * 6/2004 Nanno ..... 400/188

FOREIGN PATENT DOCUMENTS

JP 06-312549 A 11/1994

(Continued)

OTHER PUBLICATIONS

Office Action dated Jun. 7, 2006 issued in corresponding Japanese Application No. 2002-357897.

(Continued)

*Primary Examiner*—Daniel J. Colilla
*Assistant Examiner*—Marvin P. Crenshaw
(74) *Attorney, Agent, or Firm*—Westerman, Hattori, Daniels & Adrian, LLP.

(57) ABSTRACT

A duplex image forming device includes an image forming device and a reversible transportation unit. The image forming device includes a paper transportation path, a paper feed unit which transports a paper to the paper transportation path, a printing unit which prints an image onto the paper, a discharge tray where the paper printed with the image is discharged, a manual paper feed tray which is attached to a side of the image forming device, and a storage opening which is provided at a side of the image forming device and stores the manual paper feed tray. The reversible transportation unit is inserted into a side of the image forming device to cover the upper part of the storage unit. The reversible transportation unit includes a reversible transportation path for transporting out to an upstream side of the printing unit, the paper transported from the downstream side of the printing unit of the paper transportation path. The reversible transportation path is formed by passing through the storage opening.

11 Claims, 14 Drawing Sheets

FOREIGN PATENT DOCUMENTS

| | | | |
|---|---|---|---|
| JP | 10-268585 | | 10/1998 |
| JP | 10-338404 | | 12/1998 |
| JP | 031336 | * | 2/2001 |
| JP | 2001-151389 A | | 6/2001 |
| JP | 2001-206646 | | 7/2001 |
| JP | 2001-222139 A | | 8/2001 |
| JP | 2001-341946 | | 12/2001 |
| JP | 2002-116591 | | 4/2002 |
| JP | 116591 | * | 4/2002 |

OTHER PUBLICATIONS

Decision of Refusal issued in Patent Application No. 2002-357897 dated Sep. 11, 2006.

* cited by examiner

DUPLEX IMAGE FORMING DEVICE AND REVERSIBLE TRANSPORTATION UNIT

FIELD OF THE INVENTION

The present invention relates to an image forming device such as copy machine and a facsimile machine, and more particularly to a reversible transportation unit used for forming an image on both sides of a paper, and an image forming device for which the reversible transportation unit can be inserted therein.

DESCRIPTION OF RELATED ART

To form an image on both sides of a paper, a reversible transportation path has been provided for reversing the paper in a paper transportation path. After an image is formed on one side of the paper, the paper is then transported into the reversible transportation path, the sides of the paper are reversed, and an image is formed again on the other side of the paper. When such a transportation path for reversing the paper is provided in a main body of the image forming device, space inside a main body of the device increases. Therefore, when forming an image on both sides of a paper, a reversible transportation unit is inserted into the main body of the device to provide the reversible transportation path.

For example, according to one conventional image forming device, a duplex unit can be inserted into the image forming device in a manner such that the duplex unit can be replaced with a transportation unit. A pair of guide plates and a pair of transportation rollers of the paper transportation path are attached to the duplex unit side, and a manual paper feeder is disposed in the duplex unit. In this case, the installation space of the image forming device as a whole does not increase, but a layout design inside the main body of the device is limited. Moreover, it is necessary to design the image forming device in consideration of the duplex unit to be attached, and the image forming device itself is complicated. Moreover, since the manual paper feeder is held by the duplex unit, the weight of the duplex unit itself increases and it becomes difficult to handle the duplex unit.

SUMMARY OF THE INVENTION

The present invention provides a reversible transportation unit which can reduce installation space by being inserted using existing space in an image forming device without changing a layout of the image forming device greatly, and an image forming device including the reversible transportation unit.

According to the present invention, the image forming device includes a paper transportation unit which transports a paper transported-in from a paper feed unit to a printing unit and transports-out the paper to a paper discharge tray. The image forming device also includes a manual paper feed tray which is attached to a side of the main body of the device, and a reversible transportation unit which transports-out to an upstream side of the printing unit, the paper transported-in from a downstream side of the printing unit in the transportation path of the paper transportation unit. A storage opening is provided on a side of the main body of the device for storing the manual paper feed tray. The reversible transportation unit is inserted in a manner to cover an upper part of the storage opening, and a reversible transportation path is formed to pass through the storage opening. A plurality of transportation units are disposed along the reversible transportation path, and it is preferable for at least one of the transportation units to be disposed in the storage opening. Furthermore, the transportation units are preferable to be transportation rollers.

Moreover, the reversible transportation unit of the present invention is inserted into an image forming device that includes a paper transportation unit which transports a paper transported-in from the paper feed unit to the printing unit and transports-out the paper to a paper discharge tray, and a manual paper feed tray which is attached to a side of the main body of the device. The reversible transportation unit includes a reversible transportation path which transports-out to an upstream side of the printing unit, a paper transported-in from a downstream side of the printing unit in the transportation path of the paper transportation unit. Furthermore, the reversible transportation unit is preferable to have a protrusion to be inserted into the storage opening provided at a side of the image forming device for storing the manual paper feed tray. In addition, it is preferable for a part of the reversible transportation path to be formed in the protrusion.

According to the present invention, the storage opening for storing the manual paper feed tray can be used as the reversible transportation path of the reversible transportation unit. That is, when the manual paper feed tray is moved to an opened state located away from the side of the main body of the device, the space of the storage opening where the manual paper feed tray has been stored in the main body of the device becomes vacant. By using this space efficiently as the reversible transportation path, a part of the reversible transportation unit can be disposed in the main body of the device. As a result, the installation space of the reversible transportation unit can be reduced by this extent. In addition, among the plurality of transportation rollers disposed along the reversible transportation path, since at least one of the transportation rollers is disposed in the storage opening, the installation space of the transportation rollers can be located in the storage opening, and the installation space of the reversible transportation unit can be reduced even more.

Moreover, the reversible transportation unit includes the protrusion to be inserted into the storage opening, and a part of the reversible transportation path is formed in the protrusion. As a result, the space of the storage opening can be utilized efficiently, and the reversible transportation unit can be inserted into the image forming device under a more stabilized state.

DETAILED DESCRIPTION OF THE PREFERRED EMBODIMENTS

The embodiments of the present invention will be described in details. Further, in this specification, a "side" of a main body of the device means the sides other than an upper side and a lower side, and includes a front side and a back side.

Figure 1:
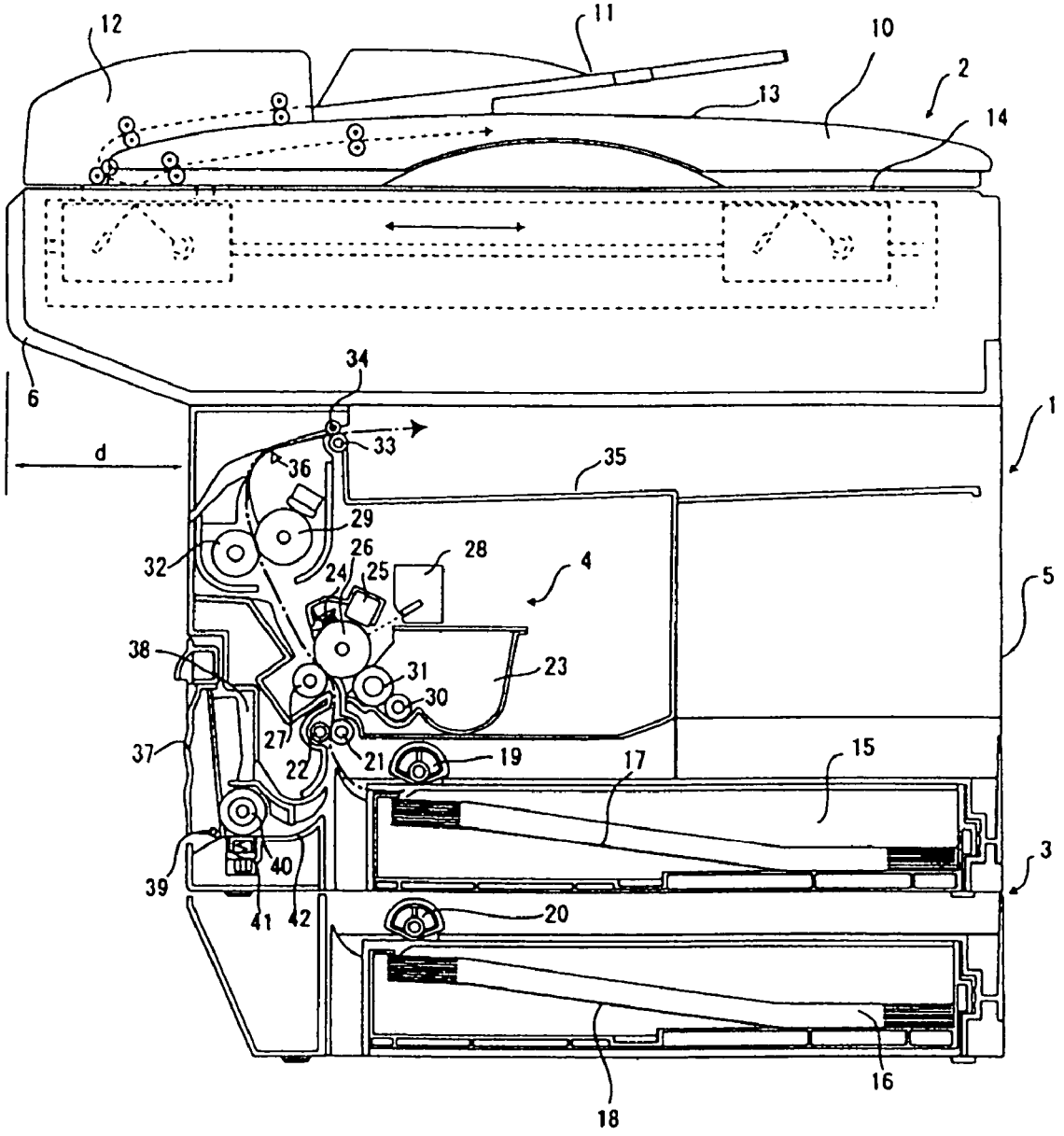
FIG. 1 is a schematic cross-sectional view showing the entire image forming device for which a reversible transportation unit is not inserted therein.
Figure 2:
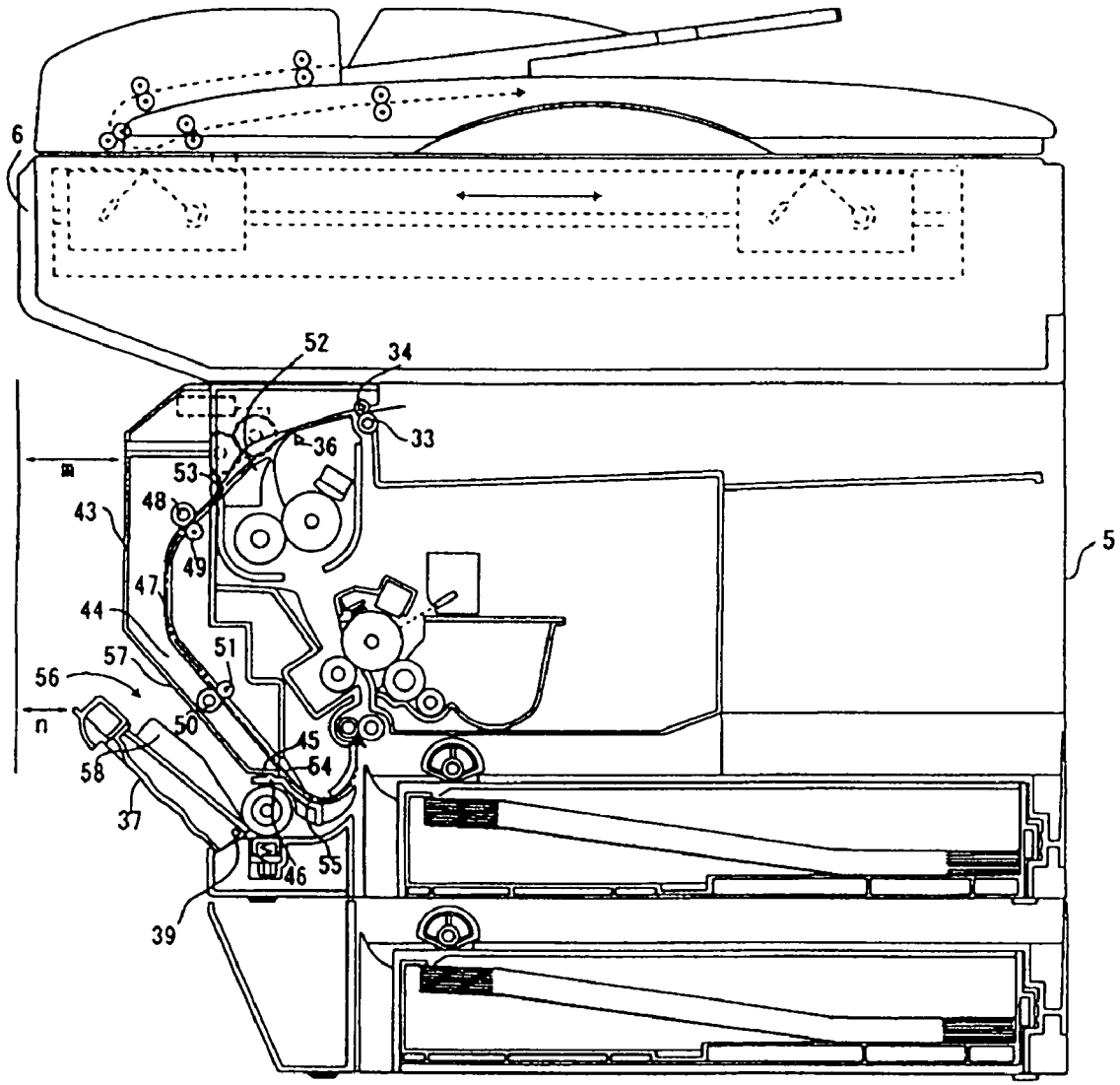
FIG. 2 is a schematic cross-sectional view showing the entire image forming device for which the reversible transportation unit is inserted therein.

FIG. 1 is a schematic cross-sectional view showing an image forming device 1 according to an embodiment of the present invention. FIG. 2 is a schematic cross-sectional view showing a state in which a reversible transportation unit 43 in inserted in the image forming device 1. A scanning unit 2 is disposed in an upper part of the image forming device 1. A paper feed unit 3 and a printing unit 4 are disposed in a lower part of the image forming device 1 in this order from the lower side.

In the scanning unit 2, a tray 11 is disposed on a cover 10. An original document placed on the tray 11 is transported by a transportation device 12 to a position facing a scanner, and a scanning operation is carried out. Then, the original document is discharged onto a discharge tray 13. When scanning an original document other than a sheeted document such as a booklet, the cover 10 is opened upward, a scanning face of the booklet is placed on a flat bed platen 14, and the booklet is scanned. The above-described structure is the same as that of a scanning device having an Auto Document Feeder (ADF) type and a flat bed type.

In the paper feed unit 3, paper feed cassettes 15 and 16 are disposed vertically one on the other, and multiple sheets of papers of prescribed sizes are stacked on flappers 17 and 18 of the paper feed cassettes 15 and 16 respectively. The right ends of the flappers 17 and 18 are supported rotatable on the frame by hinges. Pick-up rollers 19 and 20 are disposed at the left side. The flappers 17 and 18 are pushed upward so that an upper surface of the stacked papers contacts against the pick-up rollers 19 and 20. When the pick-up rollers 19 and 20 are rotated under this state, the papers are fed to a paper transportation path one sheet at a time by a frictional force.

The fed paper is transported to the printing unit 4 by a feed roller 21 and a press roller 22. To print an image onto the transported paper, the printing unit 4 includes a toner case 23, a memory erasing brush 24, a charger 25, a photoconductive drum 26, a transfer roller 27, an exposure head 28, and a fuser roller 29. First, the surface of the photoconductive drum 26 is charged uniformly by the charger 25. The charged photoconductive drum 26 is exposed by the exposure head 28 according to an image printing signal, and an electrostatic latent image is formed on the photoconductive drum 26. Next, the toner stored in the toner case 23 is transferred from the supply roller 30 via the developing roller 31 to the electrostatic latent image on the photoconductive drum 26, and the electrostatic latent image is visualized. Then, the toner image formed on the surface of the photoconductive drum 26 is transferred onto a paper by the transfer roller 27. The transferred toner image is sandwiched and heat-pressed by the fuser roller 29 and the press roller 32, and fused on the paper. The fused paper is sandwiched between a discharge roller 33 and a press roller 34 and transported out onto a paper discharge tray 35.

In FIG. 1, the dashed line shows the paper transportation path from the paper feed unit 3 to the paper discharge tray 35. A paper end detecting sensor 36 is disposed to the upstream side of the discharge roller 33.

Meanwhile, a storage opening 38 is provided at a side of the image forming device 1. A manual paper feed tray 37 is disposed in the storage opening 38. FIG. 1 shows a state in which the manual paper feed tray 37 is locked to the main body of the device by a locking member (not shown), and located at a locked position. The manual paper feed tray 37 is supported by a swing shaft 39 in a manner capable of swinging, and swings to an unlocked position shown in FIG. 2. A pick-up roller 40 for transporting the manually fed paper and a pad 41 contacting against the pick-up roller 40 are disposed in a lower part of the storage opening 38. The manually fed paper is fed by the rotation of the pick-up roller 40, and the paper is transported along a guide 42 to the feed roller 21 and the press roller 22.

FIG. 2 shows a state in which the manual paper feed tray 37 is swung outward with the swing shaft 39 as the center and spaced from the storage opening 38, i.e., a state in which the manual paper feed tray 37 is located at an unlocked position. The reversible transportation unit 43 is inserted above the manual paper feed tray 37. A protrusion 44 is formed in a lower part of the reversible transportation unit 43, and the protrusion 44 is inserted into the storage opening 38. A driving mechanism such as a motor to be described later is provided in the upper part of the reversible transportation unit 43, and the driving mechanism is inserted in the main body of the device. A claw (not shown) is formed on a bottom face 45 of the protrusion 44, and the claw is caught by a supporting table 46 of the main body of the image forming device when the reversible transportation unit 43 is inserted into the main body of the device 1. Under a state in which the reversible transportation unit 43 is inserted in the main body of the device 1, the protrusion 44 is protruding to the main body side of the device from the surface of the reversible transportation unit 43 that is contacting against the outermost side of the main body of the device 1.

A reversible transportation path 47 having a shape of approximately a horseshoe is formed in the reversible transportation unit 43. A feed roller 48 and a press roller 49 are disposed in the upper slanting transportation path, and a feed roller 50 and a press roller 51 are disposed in the lower slanting transportation path. The paper is transported through the reversible transportation path by these two pairs of transportation rollers 48–51. At least one of the feed roller 50 and the press roller 51 is disposed in the protrusion 44 to be located at a space in the storage opening 38.

In the main body of the device 1, a reversible transporting-out path is formed from the discharge roller 33 via a lower guide 52 to a paper transportation outlet 53. Moreover, in the storage opening 38, a reversible transporting-in path is formed above a manual paper feed opening from a paper transportation inlet 54 via a guide 55 to the feed roller 21. Therefore, when the reversible transportation unit 43 is inserted into the main body of the device 1, the reversible transporting-out path, the reversible transportation path 47, and the reversible transporting-in path are connected, and a transportation path is formed as shown with the dashed line in FIG. 2.

When controlling the reversible transportation of the paper, the discharge roller 33 is driven, and the paper, which an image is formed on one side, is once discharged toward the discharge tray 35. Then, in response to an output of the paper end detecting sensor 36, the discharge operation is stopped. At this time, the lower edge of the paper is sandwiched between the discharge roller 33 and the press roller 34. Then, a motor in the reversible transportation unit 43 is driven, the discharge roller 33 is rotated to transport the paper in a reverse direction, and the paper is transported with the lower edge of the paper as a head through the reversible transporting-out path to the paper transportation outlet 53. The feed roller 48 and the feed roller 50 rotate in accordance with the reverse rotation of the discharge roller 33. The paper is transported through the reversible transportation path 47, transported from the paper transportation inlet 54 to the reversible transporting-in path, and contacted against the feed roller 21 again. Then, an image is formed on the other side (back side) of the paper by the printing unit 4, and the images are formed on both sides of the paper.

A paper guide opening 56 is formed between the manual paper feed tray 37 and an opposing surface 57 of the reversible transportation unit 43 for manually feeding the paper. By forming the paper guide opening 56, both the manual paper feeding operation and the reversible transportation operation can be carried out without removing the manual paper feed tray 37 from the main body of the device. Moreover, since the paper guide opening 56 can be confirmed visually from diagonally above, a paper can be easily guided to a paper feed opening. Side guides 58 for positioning a paper are disposed on the upper surface of the manual paper feed tray 37. By sliding and positioning the side guides 58 according to the paper size, the manual paper feeding operation can be carried out accurately.

In the image forming device 1, a paper transportation path in the main body of the device is formed in a vertical direction upward from the paper feed unit 3 and connected to the discharge tray 35 located above. As described above, by forming the paper transportation path to extend in the vertical direction, the distance of the transportation path can be reduced, and the main body of the device can be downsized. Therefore, the photoconductive drum 26, the transfer roller 27 and the fuser roller 29 of the printing unit 4 are also arranged in a vertical direction along the paper transportation path, and laid out at one side in a width direction (in the example of FIGS. 1 and 2, the left side) of the main body of the device. By adopting such a layout, the installation space of the main body of the device can be brought closer to the maximum size of the papers stacked in the paper feed unit 3, and the main body of the device can be downsized. Meanwhile, since the transporting device (ADF) 12 is disposed on the left side part of the flat bed 14, when comparing the width in the longitudinal direction, as shown in FIG. 1, the scanning unit 2 is wider than a housing 5, which is located below and disposed with the paper feed unit 3 and the printing unit 4, by a distance "d".

Conventionally, to cover such a difference in the width for the purpose of design, the width of the housing 5 was formed to be the same as the width of the scanning unit 2. However, in the present embodiment, an outer frame 6 of the scanning unit 2 is disposed to protrude outward from the side frame of the housing 5, at the side where the fuser roller 29 is provided in proximity to the side frame. By adopting such a layout, even when the fuser roller 29 is heated, since space is formed to the outside of the side frame, the heat can be released efficiently. As described above, if the outer frame 6 of the scanning unit 2 is not protruding outward from the side frame of the main body of the device, there are cases where the image forming device 1 is disposed with the side frame of the fuser roller 29 side being in a close contact with a wall. In such a case, the heat is not released efficiently from the fuser roller 29, and there is a possibility to cause a failure. However, in the present embodiment, such a problem can be avoided.

Moreover, as shown in FIG. 2, the outermost position in the horizontal direction from the side frame inserted with the reversible transportation unit 43 is set to be located inward from the protrusion of the outer frame 6 of the scanning unit 2. That is, the outermost position of the reversible transportation unit is set to be located inward by the distance "m" from a vertical surface passing through the outermost position of the protrusion of the outer frame 6. By setting in such a way, the space formed by the protrusion of the outer frame 6 can be utilized effectively. Moreover, if the image forming device is placed so that the side, which is inserted with the reversible transportation unit 43, faces a passage of a person, the protrusion of the outer frame 6 restricts a path of a person and prevents a person from contacting against the reversible transportation unit 43. In other words, since the protrusion of the outer frame 6 is recognized, even if the reversible transportation unit 43 is inserted, the reversible transportation unit 43 does not interfere with the path of a person.

Moreover, the outermost position of the manual paper feed tray 37 under the unlocked state is set inward by the distance "n" from the vertical surface passing through the outermost position of the protrusion of the outer frame 6. By setting in such a way, as in the case of the reversible transportation unit 43, the space formed by the protrusion of the outer frame 6 can be utilized effectively and can be prevented from interfering with the path of a person.

Figure 3:
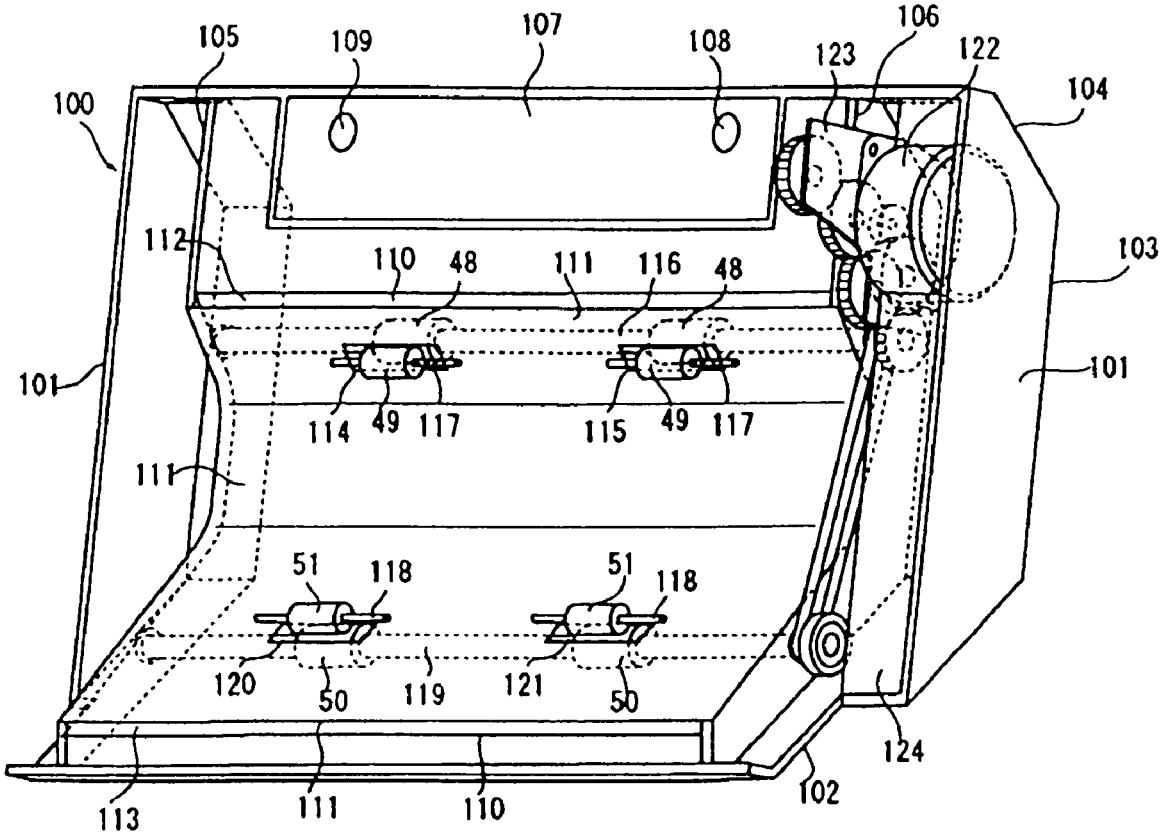
FIG. 3 is a perspective view showing the reversible transportation unit.
Figure 4:
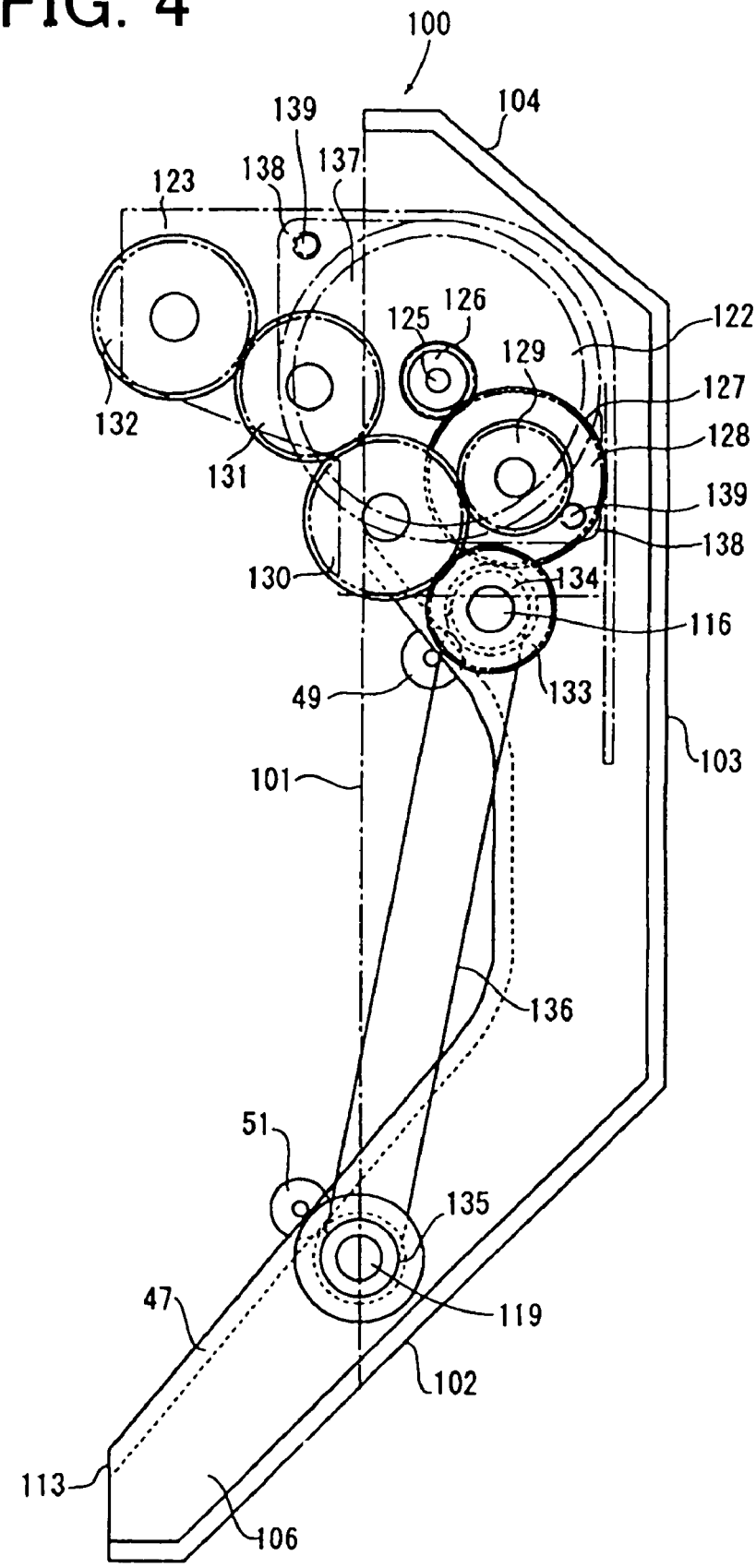
FIG. 4 is a schematic cross-sectional side view showing the reversible transportation unit.

FIG. 3 is a perspective view when viewing the reversible transportation unit 43 from inside. FIG. 4 is a schematic view of a driving mechanism when viewing the reversible transportation unit 43 from its side.

As shown in FIG. 3, left and right side frames 101, a lower frame 102, a rear frame 103 and an upper frame 104 are formed as one body to form a main body frame 100. The lower frame 102, the rear frame 103 and the upper frame 104 are formed between the left and the right side frames 101 from a lower side in this order. In addition, side guides 105 and 106 are formed inside the main body frame 100 along the reversible transportation path and fixed approximately in parallel with the side frames 101. A main body supporting plate 107 is disposed to the inner surface of the upper frame 104. Holes 108 and 109 are drilled through the main body supporting plate 107 to fix the reversible transportation unit on the main body of the device by screws or the like. The side guides 105 and 106 curving toward the rear frame 103 are formed along the reversible transportation path 47. An outer guide 110 and an inner guide 111 are disposed between the side guides 105 and 106 along the curved shape in parallel with one another with a prescribed interval. The inner guide 111 is a guide located closer to the main body of the device, and the outer guide 110 is a guide located closer to the main body frame 100. The reversible transportation path 47, and a transportation inlet 112 and a transportation outlet 113 are formed in an area surrounded by four guides, the side guides 105 and 106, the outer guide 110 and the inner guide 111. The transportation inlet 112 is connected to the paper transportation outlet 53 of the main body of the device, and the transportation outlet 113 is connected to the paper transportation inlet 54 of the main body of the device.

As described above, two pairs of transportation rollers, the feed rollers 48 and the press rollers 49, and the feed rollers 50 and the press rollers 51, are disposed in the reversible transportation path 47. The feed rollers 48 are fixed on a roller shaft 116. The roller shaft 116 is supported rotatable between the side guides 105 and 106. The press rollers 49 are fixed on roller shafts 117. The roller shafts 117 are supported rotatable by the inner guide 111. The press rollers 49 are contacting against the feed rollers 48 at openings 114 and 115 formed through the inner guide 111.

Moreover, the feed rollers 50 are fixed on a roller shaft 119. The roller shaft 119 is supported rotatable between the side guides 105 and 106. The press rollers 51 are fixed on roller shafts 118, and the roller shafts 118 are supported rotatable by the inner guide 111. The feed rollers 50 are contacting against the press rollers 51 at openings 120 and 121 formed through the inner guide 111.

For driving the feed rollers 48 and 50, a gear supporting plate 123 having a motor 122 and a gear mechanism are fixed between the side frame 101 and the side guide 106. A hole is drilled through the gear supporting plate 123, and under a state in which a motor shaft is protruding from the hole, the motor 122 is attached to the gear supporting plate 123. A part of the motor 122 is protruding outward from the side of the side frame 101. A cover member 124 is inserted along the side of the side frame 101 so that the cover member 124 covers the protrusion.

FIG. 4 is a side view when viewing the reversible transportation unit 43 from the side frame 101. To facilitate the comprehension of the gear mechanism, the side frame 101, the motor 122 and the gear supporting plate 123 are shown with dashed lines. As described above, the motor shaft 125 of the motor 122 is protruding from the hole of the supporting plate 123, and disposed to the opposite side of the side where the motor 122 is disposed on the supporting plate 123. A driving gear 126 is fixed on the motor shaft 125, and a double-reduction gear 127 is engaged with the driving gear 126. The double-reduction gear 127 consists of a larger diameter part 128 and a smaller diameter part 129, and is attached rotatable to the gear supporting plate 123. The driving gear 126 is engaged with the larger diameter part 127.

A first transfer gear 130 is engaged with the smaller diameter part 129, a second transfer gear 131 is engaged with the first transfer gear 130, and a third transfer gear 132 is engaged with the second transfer gear 131. The transfer gears 130 through 132 are attached rotatable to the gear supporting plate 123. As shown in FIG. 4, the transfer gears 130 through 132 are disposed to protrude outward (in FIG. 4, leftward) from the edge of the side frame 101. By disposing the transfer gears 130 through 132 to protrude outward, when the reversible transportation unit 43 is inserted into the image forming device, a driving transfer mechanism inside the main body of the device and the third transfer gear 132 engage with one another, and a driving force of the motor 122 is transferred.

A roller driving gear 133 is also engaged with the smaller diameter part 129. The roller driving gear 133 is fixed to the roller shaft 116 attached with the feed rollers 48. A pulley 134 is protruding from the side guide 106 of the roller driving gear 133. A pulley 135 having the same diameter as the diameter of the pulley 134 is fixed to the roller shaft 119 having the feed rollers 50. An endless belt 136 is wound around the pulley 134 and the pulley 135.

When the motor 122 is driven and the motor shaft 125 rotates, the driving gear 126 rotates and the double-reduction gear 127 rotates. Therefore, the rotation of the smaller diameter part 129 is transferred from the first transfer gear 130 to the roller driving gear 133, and the feed rollers 48 rotate. Since the pulley 134 also rotates at the same time, the pulley 135 rotates via the endless belt 136, and the feed rollers 50 rotate. As described above, the reversible transportation of the paper is carried out by the rotation of the feed rollers 48 and 50.

In the motor 122, two attaching plates 138 are disposed symmetrically with the motor shaft 125 as the center. By fixing the attaching plates 138 respectively on the gear supporting plate 123 by fixing members 129, the motor 122 is fixed on the gear supporting plate 123. The gear supporting plate 123 is fixed on the rear frame 103 by an attaching member (not shown). Under a state in which the gear supporting plate 123 is fixed, a part 137 of the motor 122 is protruding outward from the inner edge of the side frame 101 (from the left side edge in FIG. 4).

Figure 5:
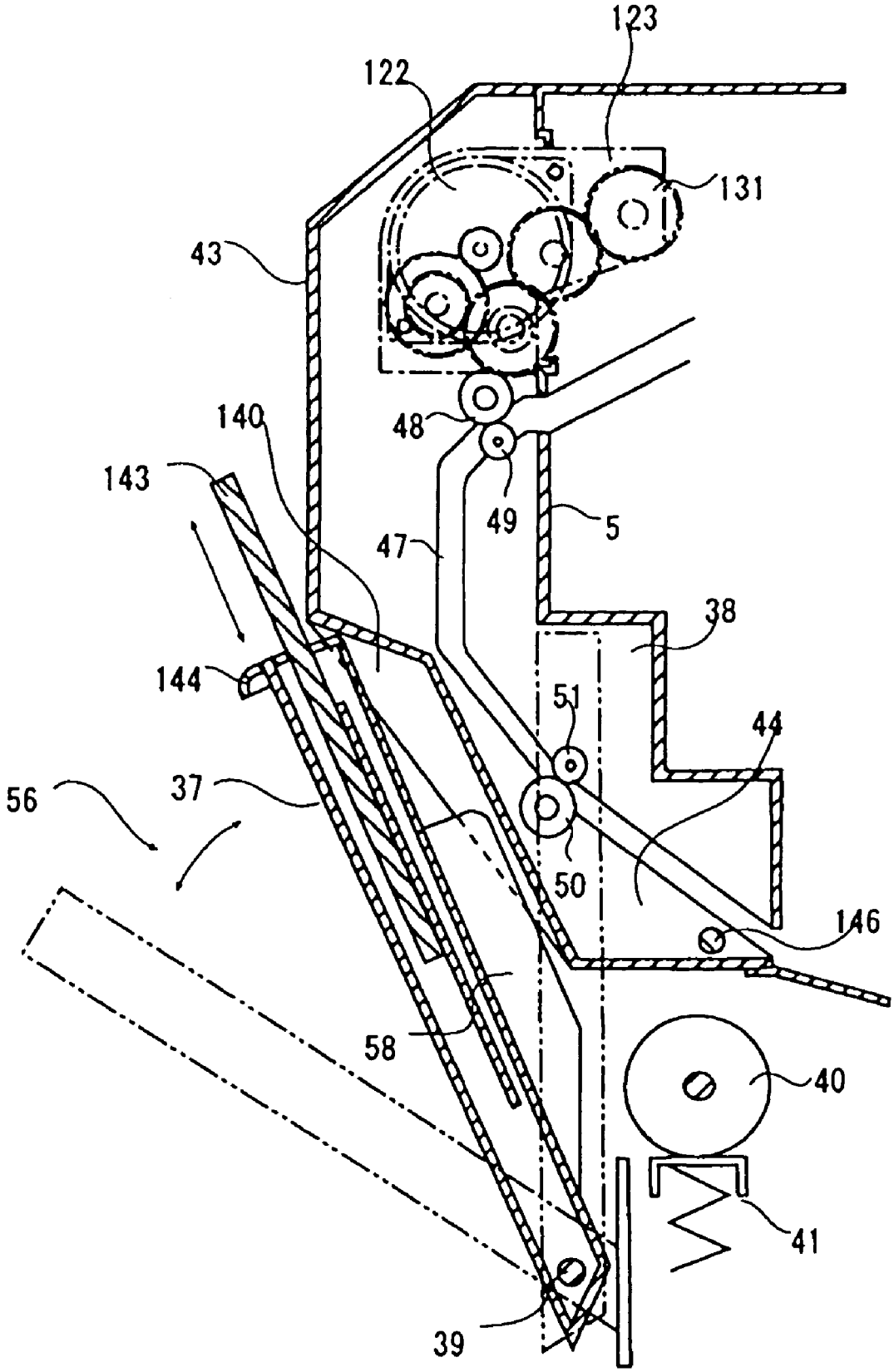
FIG. 5 is a schematic partial cross-sectional view showing a state in which the reversible transportation unit is inserted.
Figure 6:
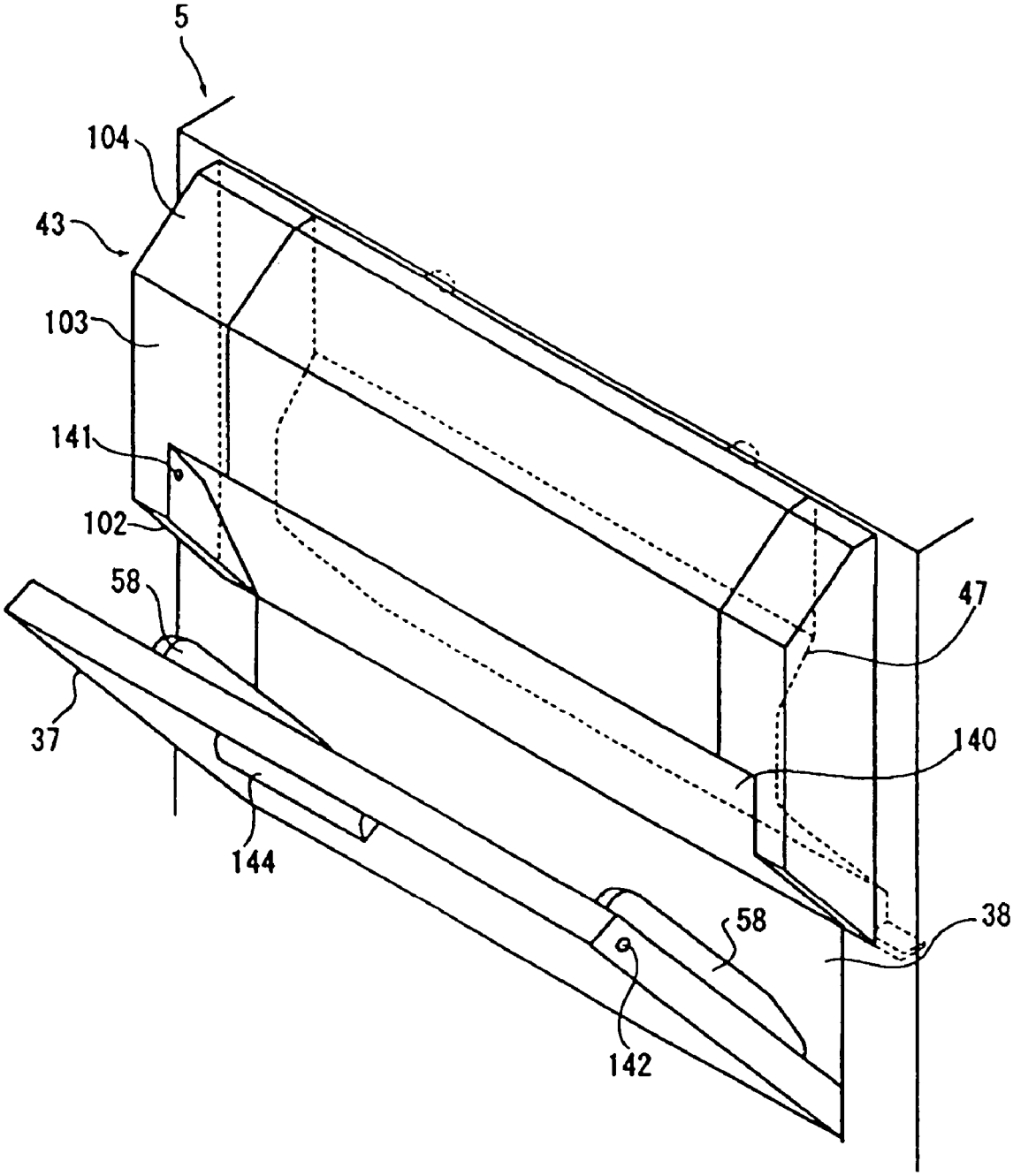
FIG. 6 is a perspective overview showing the state in which the reversible transportation unit is inserted.

FIG. 5 is a schematic partial cross-sectional view showing a state in which the reversible transportation unit 43 is inserted into the main body of the device. FIG. 6 is a perspective overview showing a state in which the reversible transportation unit 43 is inserted into the main body of the device. In the upper part of the reversible transportation unit 43, a part of the motor 122 protruding outward, and a part of the driving transfer mechanism such as the third transfer gear 132 or the like attached to the gear supporting plate 123 are inserted into the main body of the device. Moreover, in the lower part of the reversible transportation unit 43, the protrusion 44 is inserted into the storage opening 38 of the main body of the device.

In the main body frame 100 of the reversible transportation unit 43, a storage unit 140 consisting of the lower frame 102 and the rear frame 103 is formed, and the manual paper feed tray 37 is stored in the storage unit 140. As shown in FIG. 6, the storage unit 140 is formed in a concave shape having a width that is the same as the width of the manual paper feed tray 37. Both sides of the storage unit 140 are approximately in parallel with the side frames 101. Engaging protrusions 141 are formed on a surface of each of the side frames 101 facing the storage unit 140.

As shown in FIG. 5, an extension plate 143 is disposed slidable inside the manual paper feed tray 37, and a handle 144 is provided on the upper part of the manual paper feed tray 37. When the manual paper feed tray 37 is swung with the swing shaft 39 as the center and stored into the storage unit 140, the engaging protrusions 141 engage respectively with engaging concave parts 142 formed on both sides of the manual paper feed tray 37, and the manual paper feed tray 37 is held in the storage unit 140.

Figure 7:
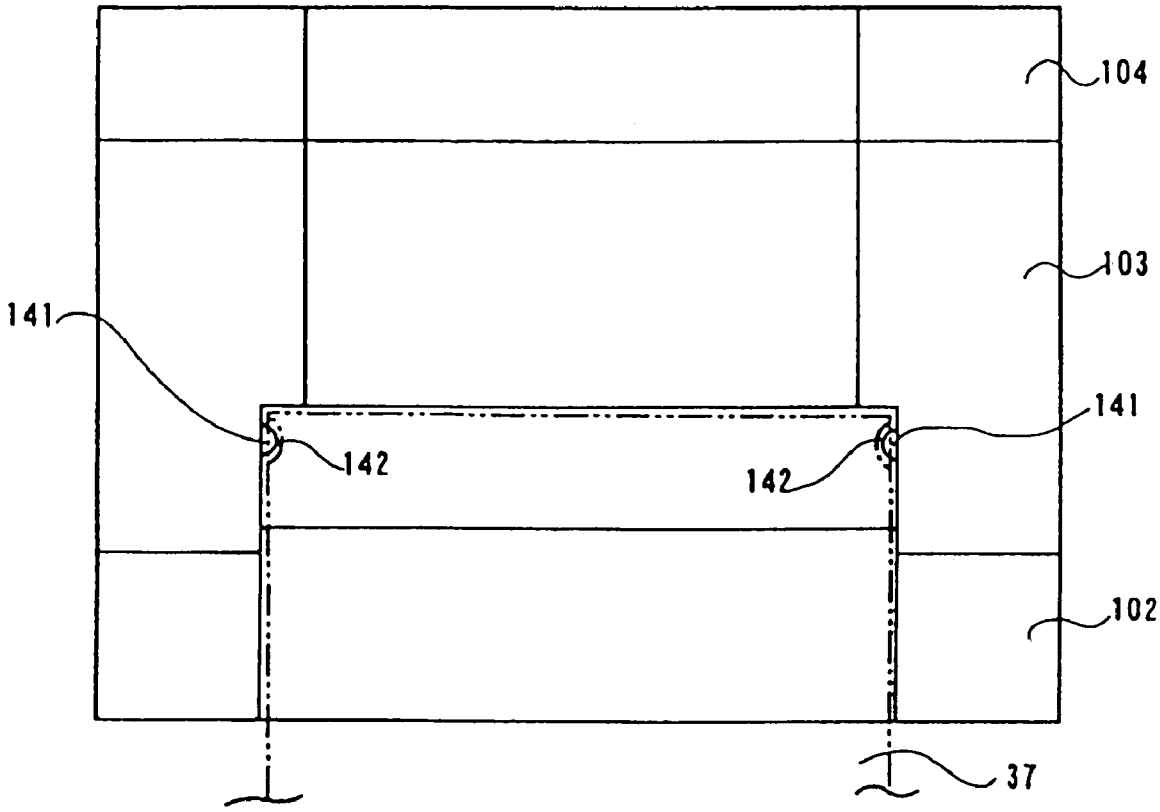
FIG. 7 is a view for describing a state in which a manual paper feed tray is stored in the reversible transportation unit.
Figure 8:
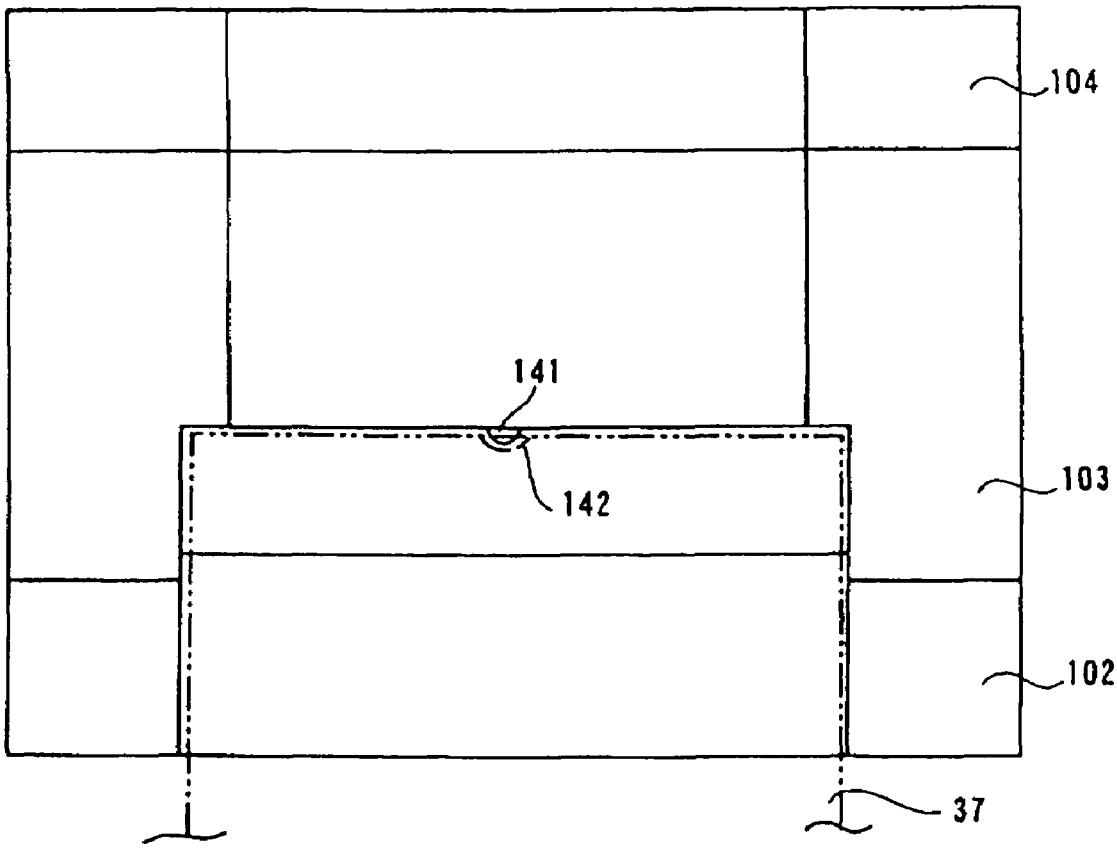
FIG. 8 is a view for describing another example of the state in which the manual paper feed tray is stored in the reversible transportation unit.

FIG. 7 is a perspective overview when viewing the manual paper feed tray 37 stored in the storage unit 140 from the rear side of the reversible transportation unit 43. The engaging protrusions 141 provided at both sides of the storage unit 140 engage with engaging concave parts 142 provided at both sides of the manual paper feed tray 37 to hold the manual paper feed tray 37. As a method for holding the manual paper feed tray 37, as shown in FIG. 8, the engaging protrusion 141 can be provided on an upper part of the storage unit 140, and the engaging concave part 142 can be provided on an upper part of the manual paper feed tray 37 to hold the manual paper feed tray 37. Further, if the manual paper feed tray 37 can be held by the storage unit 140, other methods can be adopted, and the present invention is not limited to the disclosed examples.

Figure 9:
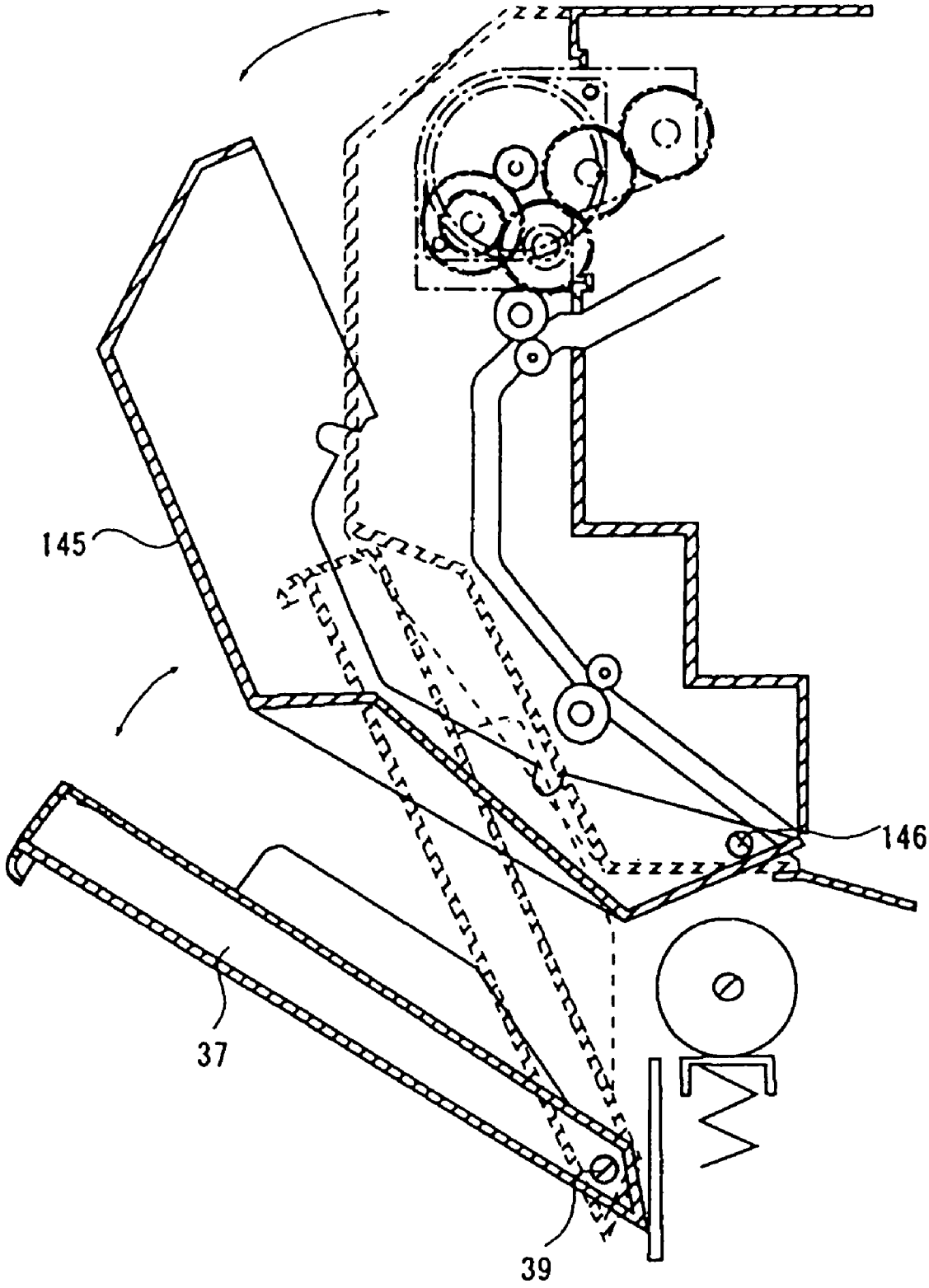
FIG. 9 is a view for describing a state in which a cover member of the reversible transportation unit is opened.

Moreover, it is preferable to form the center part of the rear frame 103 and the lower frame 102 of the reversible transportation unit 43 as a cover part 145, and the cover part 145 to be openable and closable with a swing shaft 146 as the center. As a result, a jammed paper can be easily removed from the reversible transportation path 47. In addition, since the swing shaft 39 of the manual paper feed tray 37 and the swing shaft 146 of the cover member 145 are disposed at different positions, as shown in FIG. 9, when opening the cover member 145, the engaging protrusion 141 and the engaging concave part 142 are automatically separated from one another, and the manual paper feed tray 37 also becomes under the unlocked state.

Figure 10:
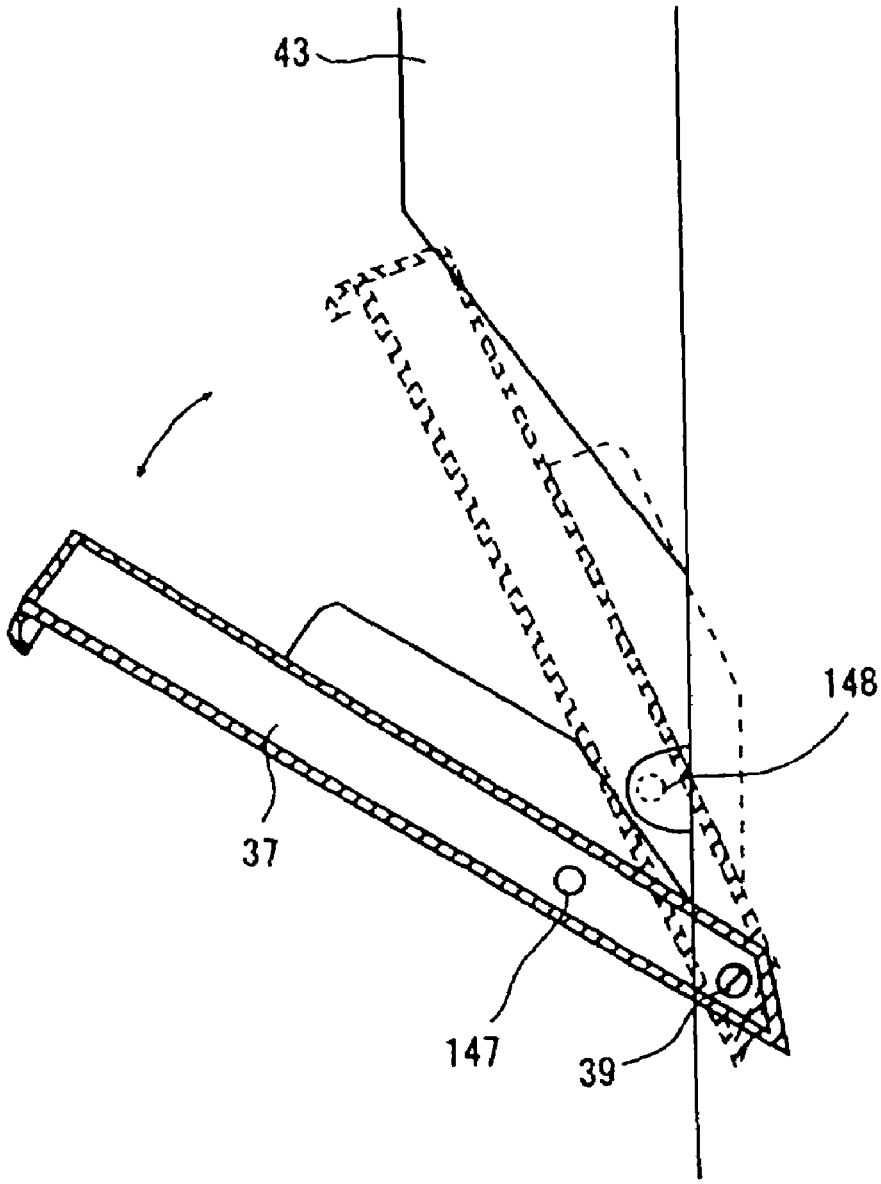
FIG. 10 is a view for describing an example where the manual paper feed tray is held by a main body of the device.

In the above-described embodiment, the reversible transportation unit 43 includes a holding unit for holding the manual paper feed tray 37, and the manual paper feed tray 37 is held to the reversible transportation unit 43 side than the maximum opened position of the manual paper feed tray 37 (position at the unlocked state as shown in FIG. 2). However, such a holding unit can be provided to the main body side of the device. For example, as shown in FIG. 10, an engaging protrusion 147 can be protruding from an intermediate part of the manual paper feed tray 37, and a bracket 148 having an engaging concave part to be engaged with the engaging protrusion 147 can be formed on the main body of the device. As a result, the manual paper feed tray 37 can be held by the bracket 148.

Figure 11:
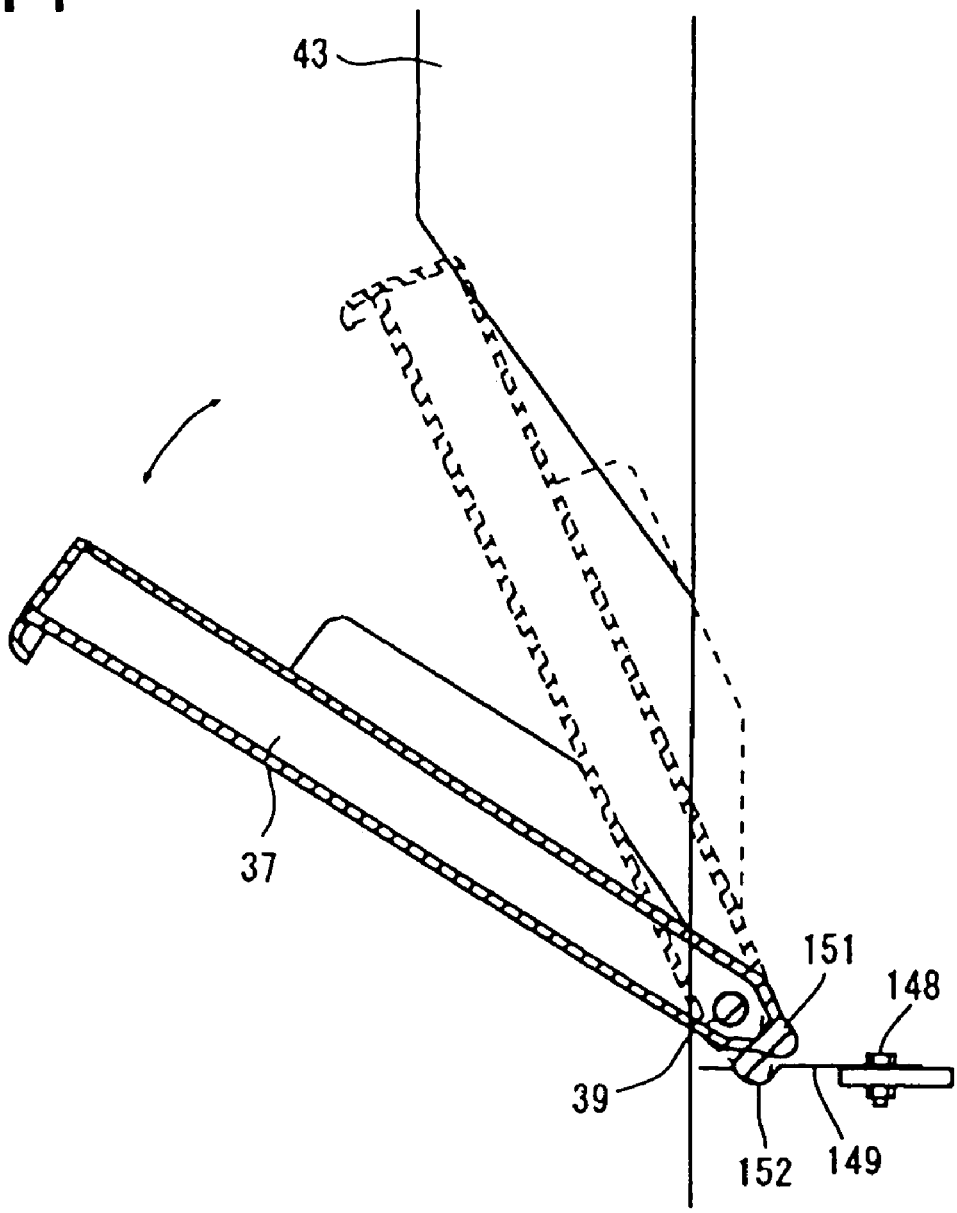
FIG. 11 is a view for describing another example where the manual paper feed tray is held by the main body of the device.

Moreover, as shown in FIG. 11, an engaging projection 151 can be formed on the manual paper feed tray 37 to the main body side of the device from the swing shaft 39. In addition, a leaf spring 149 having a curved portion 152 to be engaged with the engaging projection 151 can be fixed on the frame of the main body of the device by a screw 150. As a result, the manual paper feed tray 37 can be held by the curved portion 152 of the leaf spring 149.

Figure 12:
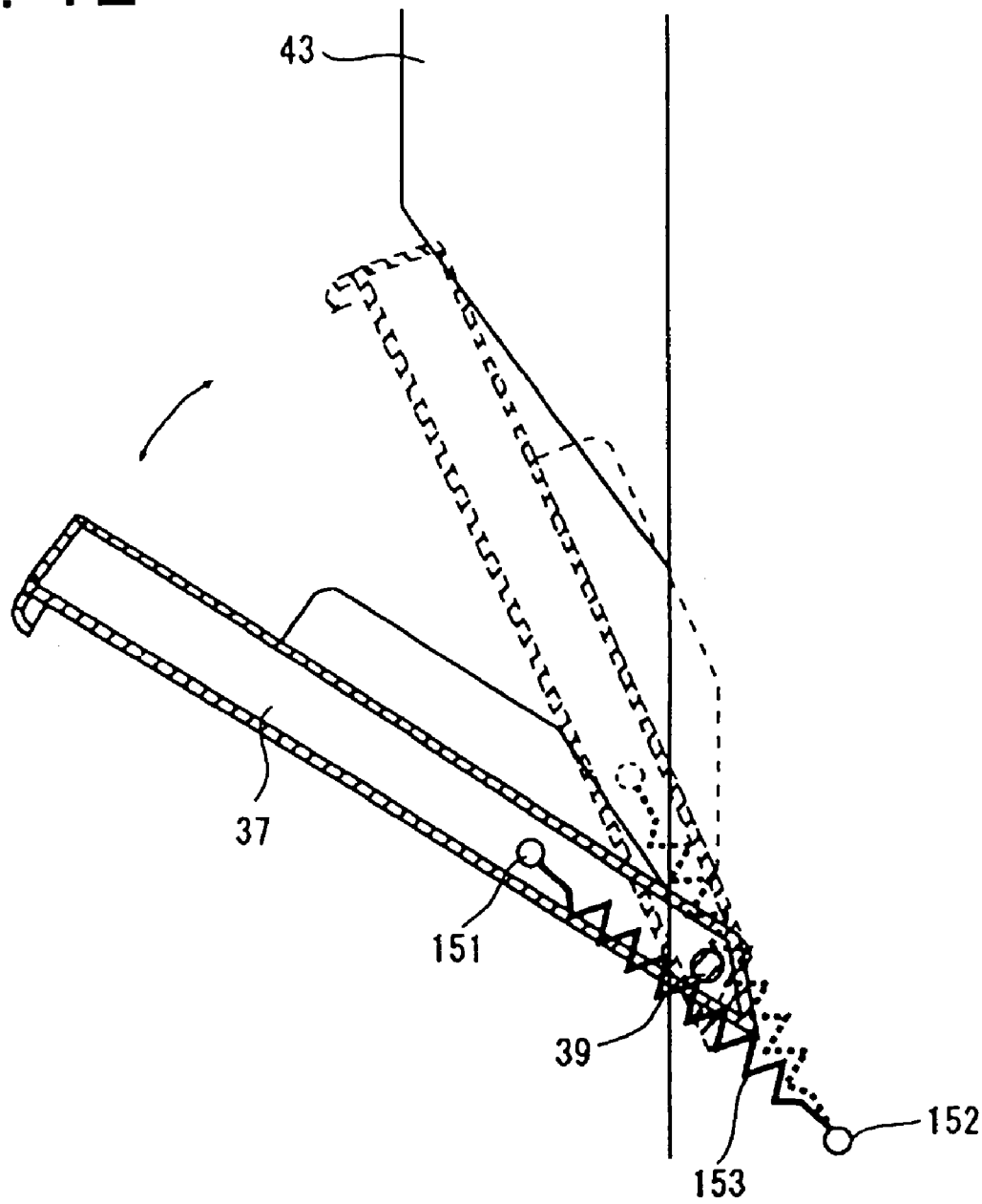
FIG. 12 is a view for describing another different example where the manual paper feed tray is held by the main body of the device.

Moreover, as shown in FIG. 12, the engaging projection 151 can be formed at an intermediate position on the manual paper feed tray 37, and an engaging projection 152 can also be formed on the main body of the device. By attaching a spring 153 between the engaging projections 151 and 152, the manual paper feed tray 37 can be held at a position where the spring 153 is moved above the swing shaft 39 or at a position where the spring 153 is moved below the swing shaft 39 by the swing of the manual paper feed tray 37.

Figure 13:
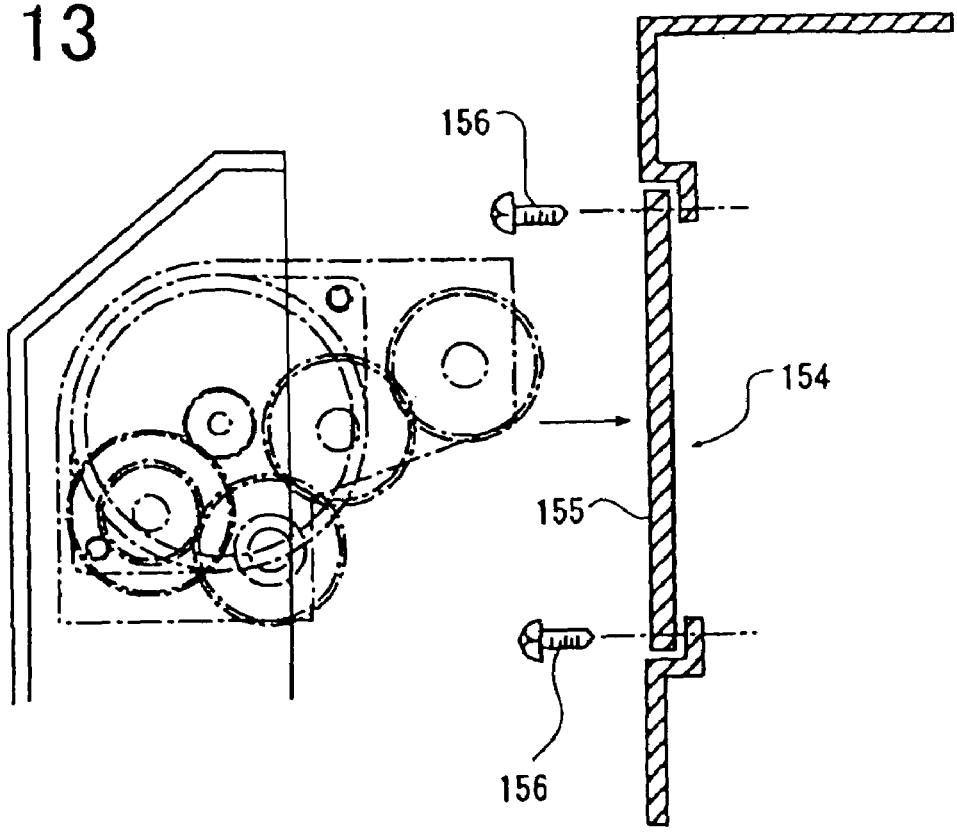
FIG. 13 is a view for describing a state in which an upper part of the reversible transportation unit is inserted into the main body of the device.
Figure 14:
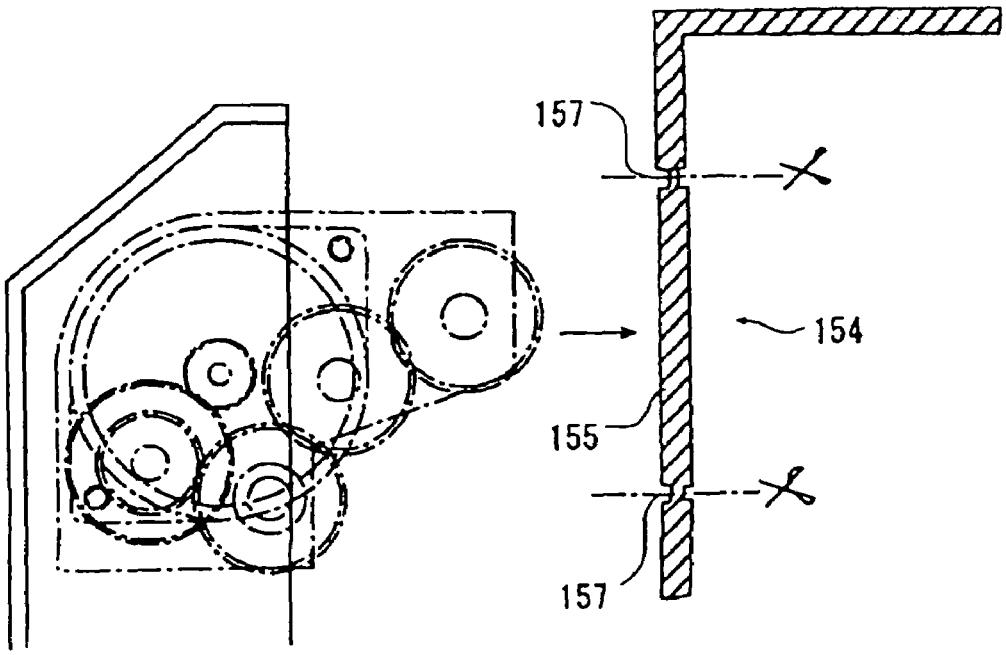
FIG. 14 is a view for describing another example of the state in which the upper part of the reversible transportation unit is inserted into the main body of the device.

In the upper part of the reversible transportation unit 43, as shown in FIG. 13, an opening 154 is provided at a position on the main body of the device where the gear supporting plate 123 attached with the motor 122 and the third transfer gear 132 or the like is inserted. In the opening 154, a cover plate 155 is mounted by screws. Therefore, when not inserting the reversible transportation unit 43, since the opening 154 is closed, dusts or the like can be prevented from entering the main body of the device. Moreover, as a method for closing the opening 154 by using other than the screws, as shown in FIG. 14, a connecting part 157 having a thickness thin enough to be cut, can be formed around the cover plate 155.

Figure 15:
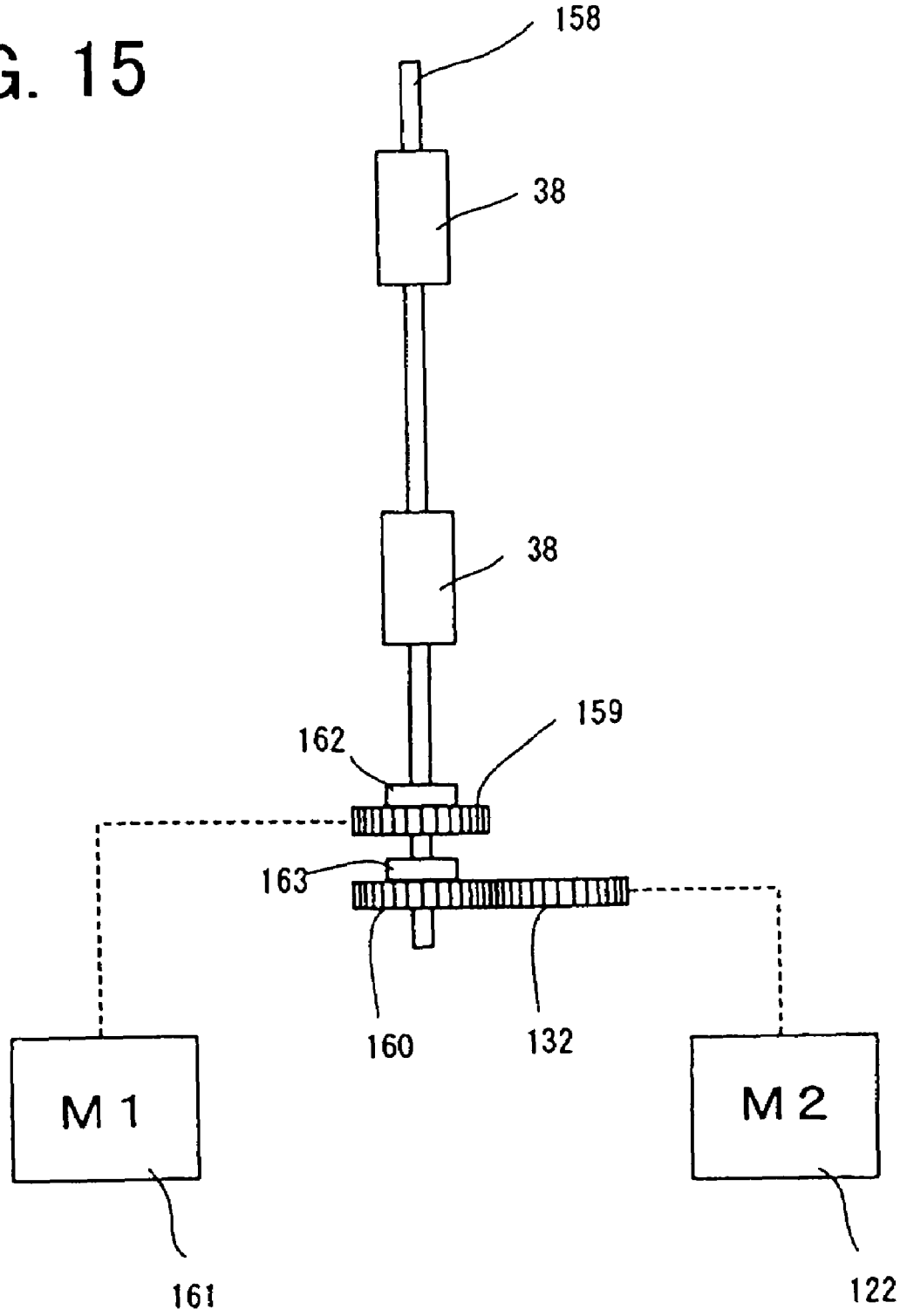
FIG. 15 is a view for describing a paper transportation driving mechanism when the reversible transportation unit is inserted.

When the reversible transportation unit 43 is inserted, as shown in FIG. 15, the third transfer gear 132 engages with a gear 160 attached on a roller shaft 158 of the discharge roller 33. The gear 160 is attached on the roller shaft 158 via a one-way clutch 163. Only when the motor 122 is rotated, the rotation of the motor 122 is transferred to the roller shaft 158 via the one-way clutch 163. Another gear 159 is attached on the roller shaft 158, and a driving force of a motor 161, which rotates and drives the transportation rollers in the main body of the device, is transferred to the gear 159. The gear 159 is attached on the roller shaft 158 via a one-way clutch 162. Only when the motor 161 is rotated, the rotation of the motor 161 is transferred to the roller shaft 158 via the one-way clutch 162. Therefore, when the motor 161 is rotated, the roller shaft 158 rotates by a driving force from the gear 159, the discharge roller 33 rotates and the paper is discharged to the discharge tray 35. At this time, the one-way clutch 163 idles, and the rotation of the roller shaft 158 is not affected.

Meanwhile, when the motor 122 rotates, the rotation of the motor 122 is transferred from the third transfer gear 132 to the gear 160. In this case, the gear 160 is rotated in a direction that is the opposite of when the motor 161 rotated. The clutch of the gear 160 is connected, and the roller shaft 158 rotates in a direction that is the opposite of when discharging the paper. Then, the discharge roller 33 transports the paper to the paper transportation outlet 53. At this time, the one-way clutch 162 idles, and the rotation of the roller shaft 158 is not affected. As described above, by setting the clutch connection to be made when the gears 159 and 160 are rotated in the opposite direction from one another, the paper discharge operation and the reversible transportation operation of the discharge roller 33 can be carried out by switching appropriately.

What is claimed is:

1. A duplex image forming device comprising:

an image forming device which includes a paper transportation path, a paper feed unit which transports a paper to the paper transportation path, a printing unit which prints an image onto the paper, a discharge tray where the paper printed with the image is discharged, a manual paper feed tray which is attached to a side of the image forming device, and a storage opening which is provided at a side of the image forming device and stores the manual paper feed tray; and a reversible transportation unit which is inserted to a side of the image forming device to cover an upper part of the storage opening, and includes a reversible transportation path that is formed to pass through the storage opening for transporting out to an upstream side of the printing unit, the paper transported from a downstream side of the printing unit in the paper transportation path, wherein the reversible transportation unit includes a main body frame having a contacting surface that contacts against a side of the image forming device, and a motor which drives the means for transporting and is disposed protruding outward from the contacting surface of the main body frame so that at least a part of the motor is disposed in the image forming device when the reversible transportation unit is inserted into the image forming device.

2. The duplex image forming device according to claim 1, further comprising a cover member which covers the part that is protruding from the contacting surface of the motor.

3. The duplex image forming device according to claim 2, wherein the cover member is provided on the reversible transportation unit.

4. A duplex image forming device comprising:

an image forming device which includes a paper transportation path, a paper feed unit which transports a paper to the paper transportation path, a printing unit which prints an image onto the paper, a discharge tray where the paper printed with the image is discharged, a manual paper feed tray which is attached to a side of the image forming device, and a storage opening which is provided at a side of the image forming device and stores the manual paper feed tray; and a reversible transportation unit which is inserted to a side of the image forming device to cover an upper part of the storage opening, and includes a reversible transportation path that is formed to pass through the storage opening for transporting out to an upstream side of the printing unit, the paper transported from a downstream side of the printing unit in the paper transportation path, wherein the reversible transportation unit includes a gear mechanism which transfers a drive from the motor, and a supporting plate which attaches the motor and the gear mechanism.

5. The duplex image forming device according to claim 4, wherein at least a part of the gear mechanism is disposed outward from the contacting surface.

6. The duplex image forming device according to claim 1, wherein the image forming device further includes an opening formed at the side of the image forming device for inserting the part that is protruding outward from the contacting surface of the motor.

7. The duplex image forming device according to claim 6, wherein the image forming device further includes a cover plate which covers the opening.

8. A reversible transportation unit inserted into an image forming device, comprising:

a reversible transportation path which transports out to an upstream side of a printing unit, a paper transported from a downstream side of the printing unit in a paper transportation path of the image forming device;

a main body frame which has a contacting surface that contacts against a side of the image forming device; and a motor which drives the means for transporting and is disposed protruding outward from the contacting surface of the main body frame so that at least a part of the motor is disposed in the image forming device when the reversible transportation unit is inserted into the image forming device, wherein the reversible transportation path is formed to pass through a storage opening which stores a manual paper feed tray attached to the image forming device.

9. The reversible transportation unit according to claim 8, further comprising a cover member which covers the part that is protruding outward from the contacting surface of the motor.

10. A reversible transportation unit inserted into an image forming device, comprising:

a reversible transportation path which transports out to an upstream side of a printing unit, a paper transported from a downstream side of the printing unit in a paper transportation path of the image forming device;

a gear mechanism which transfers a drive from the motor; and a supporting plate which attaches the motor and the gear mechanism, wherein the reversible transportation path is formed to pass through a storage opening which stores a manual paper feed tray attached to the image forming device.

11. The reversible transportation unit according to claim 10, wherein at least a part of the gear mechanism is disposed outward from the contacting surface.

* * * * *